US005542405A

United States Patent [19]

Gerhardy

[11] Patent Number: 5,542,405

[45] Date of Patent: Aug. 6, 1996

[54] MEMBRANE CARBURETOR

[75] Inventor: Reinhard Gerhardy, Korb, Germany

[73] Assignee: Andreas Stihl, Waiblingen, Germany

[21] Appl. No.: 406,413

[22] Filed: Mar. 20, 1995

[30] Foreign Application Priority Data

Apr. 2, 1994 [DE] Germany ..... 44 11 634.9

[51] Int. Cl.[6] ..... F02D 41/00

[52] U.S. Cl. ..... 123/702; 261/34.1

[58] Field of Search ..... 123/702, 701, 123/672, 437, 438; 261/DIG. 56, DIG. 58, 34.1

[56] References Cited

U.S. PATENT DOCUMENTS

| | | | |
|---|---|---|---|
| 3,900,014 | 8/1975 | Bundesen et al. | 123/702 |
| 3,974,813 | 8/1976 | Knapp et al. | 123/702 |
| 4,083,338 | 4/1978 | Bertling et al. | 123/702 |
| 4,084,562 | 4/1978 | Eckert | 123/702 |
| 4,089,311 | 5/1978 | Bretteschneider | 123/702 |
| 4,091,781 | 5/1978 | Mituyasu et al. | 123/702 |
| 4,308,835 | 1/1992 | Abbey | 123/702 |

*Primary Examiner*—Raymond A. Nelli
*Attorney, Agent, or Firm*—Walter Ottesen

[57] ABSTRACT

The invention relates to a membrane carburetor for an engine of a motor-driven chain saw. The membrane carburetor has a fuel-filled control chamber delimited by a control membrane. A throttle flap is mounted in an intake channel and a main nozzle opens into the intake channel upstream of the throttle flap. The main nozzle opening is connected to the control chamber via a fuel channel and a fixed nozzle limiting the inflowing fuel-mass flow. In order to make the mixture composition controllable, an air-supply channel opens into the fuel channel and a control valve is mounted in the air-supply channel. The control valve can be adjusted by a positioning device in dependence upon engine operating data. The positioning device is actuated by a control apparatus.

14 Claims, 3 Drawing Sheets

MEMBRANE CARBURETOR

FIELD OF THE INVENTION

The invention relates to a membrane carburetor for an internal combustion engine in a portable handheld work apparatus such as a motor-driven chain saw, cutoff machine, brushcutter or the like.

BACKGROUND OF THE INVENTION

A membrane carburetor is disclosed in U.S. patent application Ser. No. 08/325,939, filed Oct. 19, 1994. Here, the main nozzle path between the control chamber and the venturi section of the intake channel is defined by a first fixed throttle as an uncontrolled path and by a second fixed throttle as a controlled path. The fuel throughput of the controlled path can be changed with the aid of an adjusting screw by the operator. The inflowing fuel quantity is limited by the fixed throttle also for the fully opened controlled path. The total flow of the fuel quantity, which enters into the venturi section via the main nozzle path, is therefore limited so that the maximum fuel-mass flow can be set at the factory for the full-load case so that statutory exhaust-gas values can be maintained.

The known solution has been proven in practice but introduces a considerable complexity when forming the controlled path. This is so because the fuel-mass flow, which flows via the controlled path, is relatively slight compared to the fuel mass flowing through the uncontrolled path. For this reason, a highly precise control valve musk be provided for obtaining a sensitive control. In a control valve of this kind, a mixture adjustment can be made manually which is orientated to the user in order, for example, to obtain high rpm in the full-load case or good acceleration performance.

In practical use, the internal combustion engine is adjusted to the external conditions at the work site and this is time consuming and delays the operational readiness of a work apparatus. If it is further considered that catalytic converters are also utilized in motor-driven chain saws for reducing exhaust-gas emissions, then the air/fuel mixture supplied to the engine must be adapted in order not to deteriorate the operability of the catalytic converter.

SUMMARY OF THE INVENTION

It is an object of the invention to provide a membrane carburetor which is so improved that an air/fuel mixture is made available to the engine which is adapted to the external operating conditions without intervention by the operator.

The invention is for a membrane carburetor for an internal combustion engine in a portable handheld work apparatus including a motor-driven chain saw, cutoff machine and brushcutter. The membrane carburetor includes: a carburetor housing defining an air-intake channel communicating with the engine and through which a stream of air flowing in an intake flow direction is drawn by suction when the engine is operating; a throttle flap pivotally mounted in the air-intake channel; the carburetor housing further defining an interior space; a control membrane mounted in the interior space so as to define a control chamber therein bounded by the membrane; fuel supply means for supplying fuel to the control chamber; a main nozzle opening into the air-intake channel upstream of the throttle flap when viewed in the intake flow direction for metering fuel into the channel; fuel channel means for conducting a fuel-mass flow from the control chamber to the main nozzle opening; fixed fuel throttle means for limiting the fuel-mass flow flowing to the main nozzle opening; an air-supply channel for conducting air into the fuel channel means; a control valve mounted in the housing for adjustably throttling the air supplied via the air-supply channel; actuating means for actuating the control valve; and, control means for controlling the actuating means to adjust the control valve in dependence upon at least one of a plurality of operating variables of the engine.

The fixed throttle is dimensioned to the maximum permissible fuel-mass flow because the fixed throttle is provided as the only connection of the main nozzle opening to the control chamber. The air line, which opens into the fuel channel, can be throttled via the control valve. This control valve can be simply configured because air is a medium which is easy to control. This simple configuration of the control valve in combination with the air as a medium to be controlled makes possible the use of an adjusting device which can be adjusted by a control apparatus in dependence upon engine operating data. Engine operating data of this kind can include the quality of the exhaust gas, the rpm of the engine, the temperature of the engine, the rpm constancy or the like.

Preferably, the air channel opens into an emulsion chamber provided in the fuel channel so that the inflowing air is intimately mixed with the fuel inflowing via the fuel fixed throttle and so that a homogeneous emulsion exits at the main nozzle opening.

In a preferred embodiment, the control unit is connected to a lambda probe mounted in the exhaust-gas flow of the internal combustion engine so that a control of the mixture composition takes place in dependence upon the oxygen content in the exhaust-gas flow. This makes an effective utilization of catalytic converters possible even for portable handheld work apparatus equipped with two-stroke engines and further ensures that the membrane carburetor is adapted to elevation above sea level in a simple manner.

The adjusting device is advantageously a position motor such as an electrical step motor which acts on the adjusting screw of the valve needle. In another embodiment, the adjusting device is configured with the control valve as an electromagnetic stroke valve such as a proportional valve.

The electrical power consumption is held low preferably by providing a pneumatic servo device which converts the crankcase pressure or the intake channel underpressure into a positioning force.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
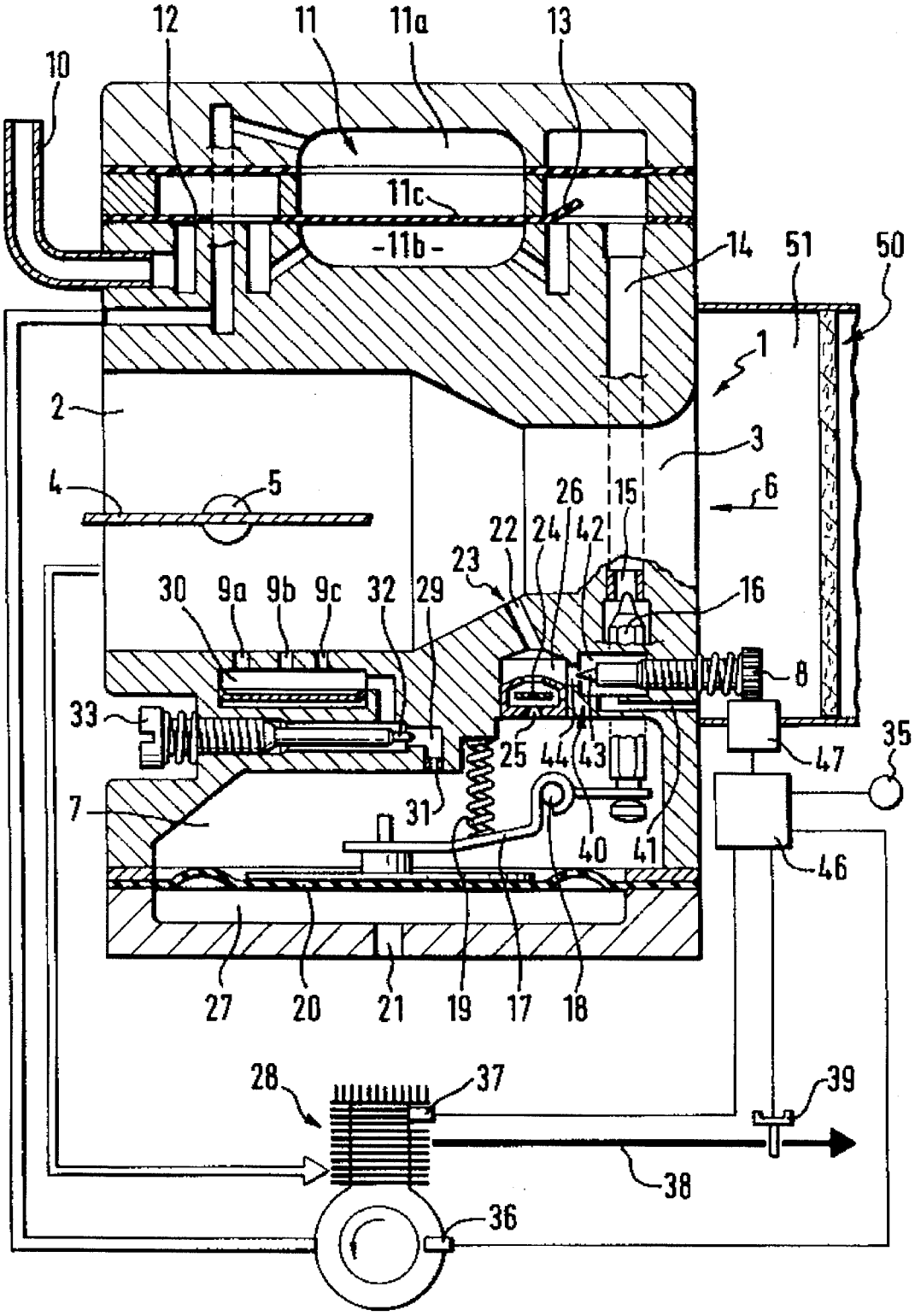
FIG. 1 is a section view taken through a membrane carburetor mounted on an internal combustion engine.

The membrane carburetor 1 shown in FIG. 1 has an intake channel 2 with a venturi section 3. A throttle flap 4 is pivotally journalled by means of a shaft 5 in the intake channel 2 downstream of the venturi section 3. The intake channel 2 of the carburetor 1 communicates with the intake opening of an internal combustion engine 28 such as a two-stroke engine. The fuel/air mixture is drawn in by suction in the flow direction indicated by arrow 6. The exhaust gases of a combustion are discharged via an outlet opening and form an exhaust-gas flow 38.

The carburetor 1 is connected via a fuel line 10 to a fuel tank (not shown). A membrane pump 11 is provided in the housing of the membrane carburetor for pumping the fuel. The membrane pump 11 has a work chamber 11*a* and a pump chamber 11*b*. The work chamber 11*a* and the pump chamber 11*b* are partitioned from each other by a membrane 11*c*. The work chamber 11*a* is connected via channels to the crankcase of the internal combustion engine 28. For this reason, the membrane pump 11 is driven by the changing crankcase pressure. When there is an underpressure, fuel is drawn in by suction into the pump chamber 11*b* via the check valve 12 mounted at the suction end. For overpressure, the fuel, which is drawn by suction into the pump chamber 11*b*, is pumped into a fuel feed line 14 via the check valve 13 mounted at the pressure end. The fuel feed line 14 opens into a control chamber 7 of the membrane carburetor.

The opening 15 of the fuel feed line 14 into the control chamber 7 is closed by a valve body 16 of a feed valve and the valve body is supported at one end of an angle lever 17. The angle lever 17 is pivotable about a lug 18 and a pressure spring 19 resiliently biases the angle lever 17 in the direction of closure of the valve body 16. The spring 19 presses the other end of the angle lever 17 against a stop in the center of the control membrane 20 which delimits the control chamber 7. The dry side 27 of the membrane 20 faces away from the control chamber 7 and this dry side is charged with atmospheric pressure or another suitable reference pressure level via an opening 21 provided in the housing cover.

A main nozzle opening 23 opens into the intake channel 2 upstream of the throttle flap 4 in the region of the venturi section 3. The main nozzle opening 23 is connected via a fuel channel 22 to the control chamber 7. The channel 22 has a fixed throttle 25 for the fuel at its end facing toward the control chamber 7. The fixed throttle 25 limits the fuel-mass flow from the control chamber 7 to the main nozzle opening 23. An unbiased valve platelet 24 is provided for the fixed throttle 25 and prevents a reaction on the pressure level in the control chamber 7 by the pressure changes in the intake channel 2 or in the fuel channel 22.

An emulsion chamber 26 is provided in flow direction from the control channel 7 into the venturi section 3. The emulsion chamber 26 is located downstream of the fixed throttle 25. An air-supply channel 41 opens into the emulsion chamber 26. A control valve 40 is mounted in the air-supply channel 41. The air quantity flowing into the emulsion chamber 26 can be controlled by the control valve 40. The control valve 40 is preferably configured as a needle valve. The control cone 43 of the needle valve engages a valve opening 44. The valve opening 44 connects an air chamber 42 to the emulsion chamber 26 and the air-supply channel 41 opens into the air chamber 42.

In the embodiment of FIG. 1, the air-supply channel 41 branches from the pure air end 51 of an air filter 50 connected upstream of the intake channel 2. A danger of contamination in the area of the control valve 40 is reduced by the entry of filtered air.

Figure 2:
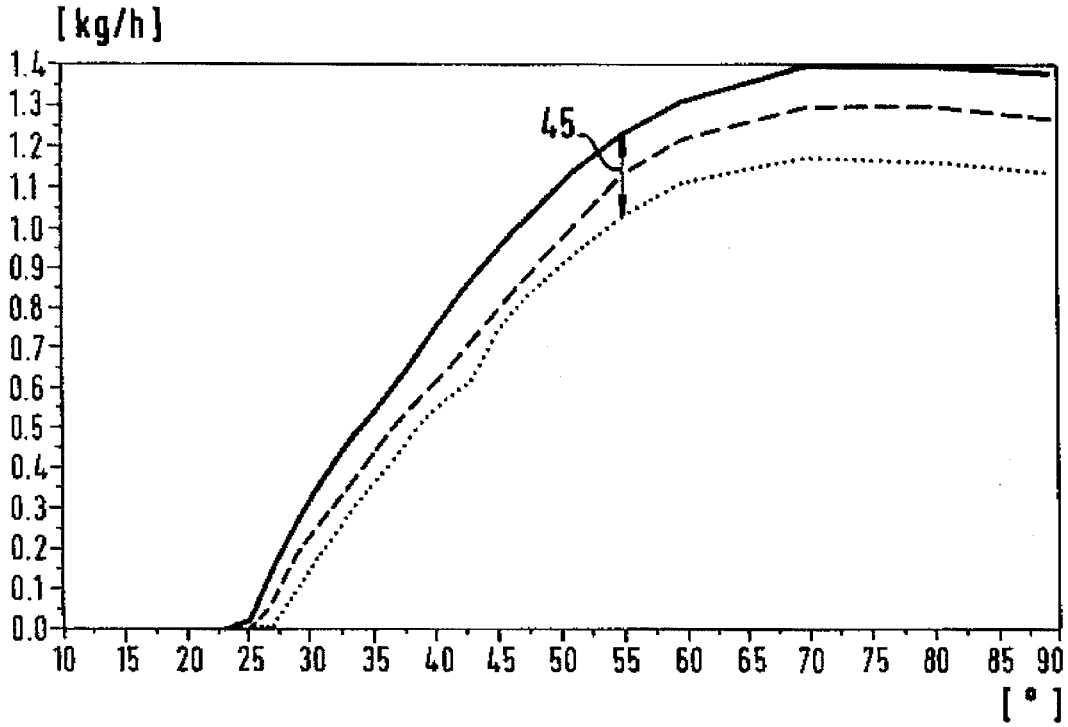
FIG. 2 is a diagram of the fuel-mass flow through the main nozzle opening plotted as a function of the throttle flap angle.

The fixed throttle 25 is so dimensioned that, when the valve opening 44 is closed, a maximum fuel-mass flow in kg/h is given in dependence upon the position of the throttle flap 4 as shown in FIG. 2 by the solid line. This maximum fuel-mass flow is so dimensioned that exhaust-gas emissions occur which can be tolerated and are less than statutory limit values.

Figure 3:
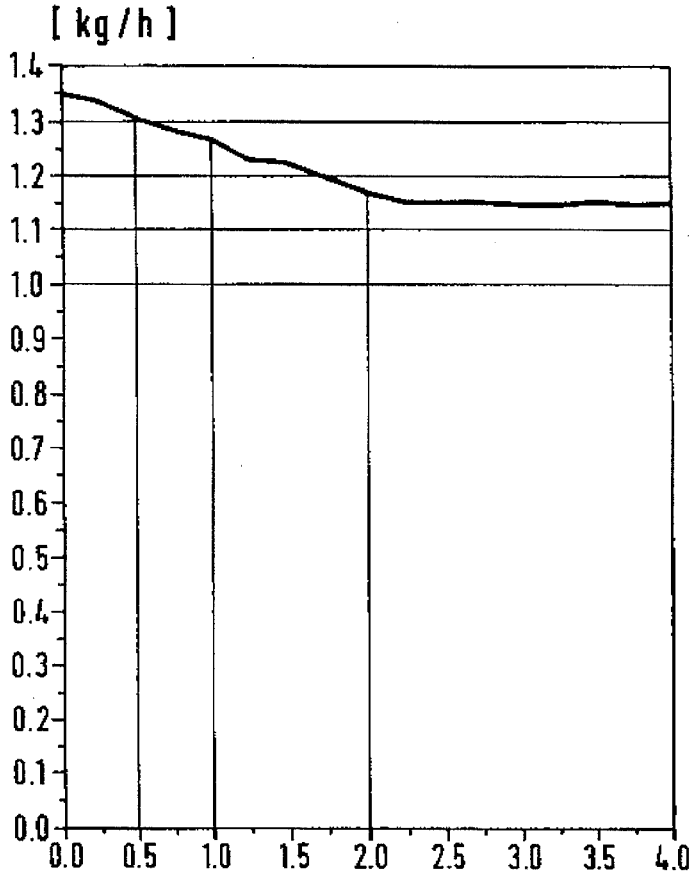
FIG. 3 is a diagram of the fuel-mass flow plotted as a function of the degree of opening of the air-control valve; and, FIG. 4 is an enlarged view of a detail of a membrane carburetor according to another embodiment of the invention.

As shown in FIG. 3, a fuel-mass flow of 1.35 kg/h is given for the embodiment shown when the throttle flap 4 is completely opened and the control valve 40 is closed. The control cone 43 is axially displaced out of the valve opening 44 by rotating the adjusting screw 8. Air enters the emulsion chamber 26 via the air-supply channel 41. For a one-half rotation of the adjusting screw 8, the fuel-mass flow drops to 1.3 kg/h. The fuel-mass flow can be reduced by further rotating the adjusting screw 8 in the open direction and can be reduced to 1.17 kg/h with two rotations of the adjusting screw 8.

If the air-control valve 40 is opened by one rotation of the adjusting screw 8 starting from the closed position, then a fuel-mass flow plotted as a function of throttle-flap angle results as shown in FIG. 2 by the dash line. With two rotations in the open direction, a mass flow results as shown by the dotted line in FIG. 2. Accordingly, the fuel-mass flow from the main nozzle opening 23 can be changed via the air-control valve 40 in the each position of the throttle flap.

Starting from a center setting of the control cone 43, the air/fuel mixture supplied to the engine 28 can be enriched or made lean via the control valve 40. The underpressure acting downstream of the fixed throttle 25 is reduced by opening the air-control valve 40. The start of the effect of the throttle flap is only slightly displaced. In the embodiment shown, the displacement amounts to a throttle flap angle of only approximately 5°.

The adjustment of the mixture via the air-control valve 40 makes possible a control at $\lambda$=constant especially for a membrane carburetor 1. This is especially suited for the use of catalytic converters. A lambda probe 39 measures the oxygen concentration in the exhaust-gas flow 38. The lambda probe 39 is mounted in the exhaust-gas flow 38 and is connected to a control apparatus 46 which actuates a positioning device 47 in dependence upon the output signal of the lambda probe 39. The positioning device 47 can be a step motor or the like which rotates an adjusting screw 8 as shown schematically in FIG. 1 so that the rotational position of the adjusting screw 8 and therefore the composition of the mixture supplied to the engine 28 can be adjusted in dependence upon the oxygen content in the exhaust-gas flow 38. A control range 45 is given especially in the region starting at approximately a 50° angular position of the throttle flap starting from an intermediate open position of the air-control valve 40. This makes possible a significant leaning or enrichment of the mixture.

It is emphasized that an adaptation for elevation is ensured with a lambda control of this kind in a simple manner. In addition, or alternately to a lambda probe 39, the control apparatus 46 can be connected to a temperature sensor 37 for detecting the operating temperature of the engine and/or to an rpm sensor 36 in order, for example, to ensure a high rpm constancy in the full-load case via the control of the mixture composition.

Figure 4:
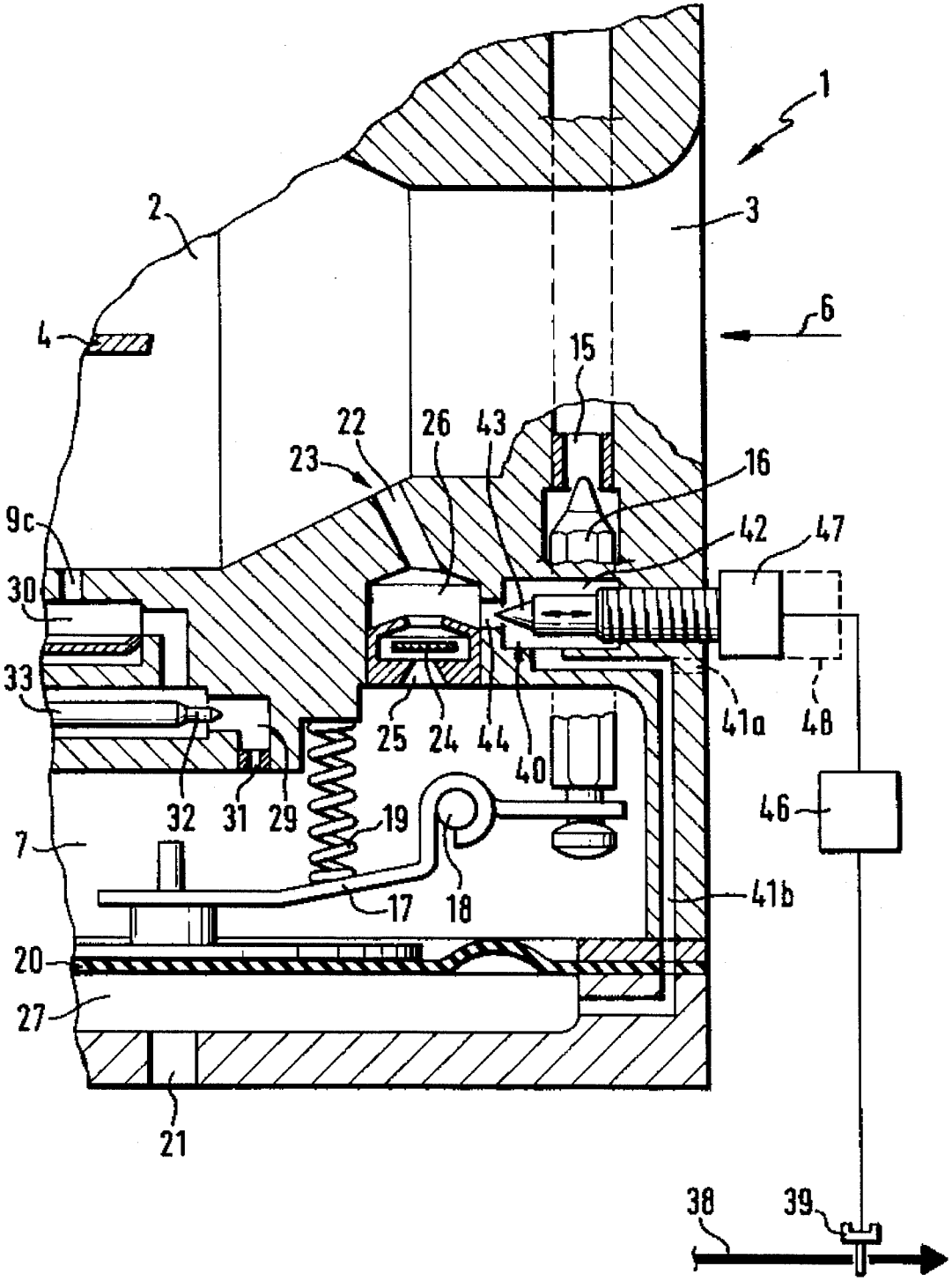

The assembly of the membrane carburetor in the embodiment of FIG. 4 corresponds essentially to that shown in FIG. 1 and like parts are identified by the same reference numerals. The control valve 40 is configured as an electromagnetic stroke valve. The valve needle is movable in the direction of the double arrow. This valve can be configured as a proportional valve. An operation as a two-position valve is also suitable with the needle valve being switched between the closed and open positions at a variable frequency.

As further shown in FIG. 4 in phantom outline, the control valve 40 can also be controlled via a servo device 48 which, for example, can be configured as a pneumatic actuating member. The actuating force can be derived from the underpressure in the intake channel 2 or from the alternating crankcase pressure of the engine.

In the embodiment of FIG. 4, the air chamber 42 of the control valve 40 is connected via an air-supply channel 41*b* to the dry side 27 of the control membrane 20 so that, if necessary, a reference pressure level at the dry side 27 of the control membrane 20 can change the underpressure downstream of the fixed throttle 25 via the air-control valve 40, that is, the underpressure in the emulsion chamber 26.

It can also be advantageous to supply air directly from the atmosphere via the air-supply channel 41*a*.

A barometric sensor 35 (pressure-measuring cell) is used in order to obtain an automatic adaptation to elevation without detecting operating parameters.

It is understood that the foregoing description is that of the preferred embodiments of the invention and that various changes and modifications may be made thereto without departing from the spirit and scope of the invention as defined in the appended claims.

What is claimed is:

1. A membrane carburetor for an internal combustion engine in a portable handheld work apparatus including a motor-driven chain saw, cutoff machine and brushcutter, the membrane carburetor comprising:

a carburetor housing defining an air-intake channel communicating with the engine and through which a stream of air flowing in an intake flow direction is drawn by suction when the engine is operating;

a throttle flap pivotally mounted in said air-intake channel;

said carburetor housing further defining an interior space;

a control membrane mounted in said interior space so as to define a control chamber therein bounded by the said membrane;

fuel supply means for supplying fuel to said control chamber;

a main nozzle opening into said air-intake channel upstream of said throttle flap when viewed in said intake flow direction for metering fuel into said channel;

fuel channel means for conducting a fuel-mass flow from said control chamber to said main nozzle opening;

fixed fuel throttle means for limiting said fuel-mass flow flowing to said main nozzle opening;

an air-supply channel for conducting air into said fuel channel means;

a control valve mounted in said housing for adjustably throttling the air supplied via said air-supply channel;

actuating means for actuating said control valve; and, control means for controlling said actuating means to adjust said control valve in dependence upon at least one of a plurality of operating variables of said engine.

2. The membrane carburetor of claim 1, said fuel channel means being a fuel channel formed in said housing and said fuel channel and said fixed fuel throttle means being connected in series between said main nozzle opening and said control channel; and, said air-supply channel opening into said fuel channel between said fixed fuel throttle means and said main nozzle opening.

3. The membrane carburetor of claim 2, said air-supply channel opening into said fuel channel directly next to said fixed fuel throttle means.

4. The membrane carburetor of claim 1, further comprising an emulsion chamber disposed between said fuel channel means and said fixed fuel throttle means; and, said air-supply channel opening into said emulsion chamber.

5. The membrane carburetor of claim 1, wherein said operating variables include exhaust gas quality, engine rpm and engine temperature; and, said membrane carburetor further comprises a sensor for detecting one of said operating variables and for producing a signal indicative of said one operating variable; and, said control means being connected to said sensor for receiving said signal.

6. The membrane carburetor of claim 5, wherein said engine discharges exhaust gas; and, said sensor being a lambda probe mounted in said exhaust gas.

7. The membrane carburetor of claim 1, said actuating means being a positioning motor.

8. The membrane carburetor of claim 7, said positioning motor being a step motor.

9. The membrane carburetor of claim 1, said control valve and said actuating means conjointly defining an electromagnetic stroke valve.

10. The membrane carburetor of claim 9, said electromagnetic stroke valve being a proportional valve.

11. The membrane carburetor of claim 1, said actuating means comprising a pneumatically operating servo unit.

12. The membrane carburetor of claim 1, said control valve being a needle valve.

13. The membrane carburetor of claim 1, said control membrane having a dry side facing away from said control chamber; air supply means supplying air at a predetermined pressure to said dry side; and, said air-supply channel communicating with said dry side.

14. The membrane carburetor of claim 1, further comprising an air filter being mounted upstream of said air-intake channel for filtering said stream of air; said air filter having an inlet side and a clean air outlet side; and, said air-supply channel communicating with said clean air outlet side of said air filter.

* * * * *